US007614995B2

(12) United States Patent
Schulz et al.

(10) Patent No.: US 7,614,995 B2
(45) Date of Patent: Nov. 10, 2009

(54) CENTRIFUGE HAVING SOLIDS DISCHARGE NOZZLES WITH WEAR PROTECTION

(75) Inventors: Dieter Schulz, Oelde (DE); Jürgen Linnemann, Beckum (DE); Anton Kleimann, Oelde (DE)

(73) Assignee: Westfalia Separator AG, Oelde (DE)

( * ) Notice: Subject to any disclaimer, the term of this patent is extended or adjusted under 35 U.S.C. 154(b) by 550 days.

(21) Appl. No.: 10/539,063

(22) PCT Filed: Dec. 15, 2003

(86) PCT No.: PCT/EP03/14253

§ 371 (c)(1),
(2), (4) Date: Mar. 22, 2006

(87) PCT Pub. No.: WO2004/054719

PCT Pub. Date: Jul. 1, 2004

(65) Prior Publication Data

US 2006/0166803 A1 Jul. 27, 2006

(30) Foreign Application Priority Data

Dec. 16, 2002 (DE) ..... 202 19 551 U

(51) Int. Cl.
*B04B 1/10* (2006.01)

(52) U.S. Cl. ..... 494/56

(58) Field of Classification Search ..... 494/2–4, 494/53–54, 56–57, 68–73; 210/380.1, 380.3
See application file for complete search history.

(56) References Cited

U.S. PATENT DOCUMENTS

| | | | | |
|---|---|---|---|---|
| 2,060,239 | A | 11/1936 | Peltzer | |
| 2,695,748 | A | 11/1954 | Millard | |
| 3,075,696 | A | 1/1963 | Fitzsimmons | |
| 3,108,952 | A | 10/1963 | Antz | |
| 3,228,598 | A | 1/1966 | Keith | |
| 5,244,584 | A * | 9/1993 | Schlieperskoetter | 210/787 |
| 7,374,529 | B2 * | 5/2008 | Hensley et al. | 494/53 |
| 2006/0166803 | A1 * | 7/2006 | Schulz et al. | 494/56 |

FOREIGN PATENT DOCUMENTS

| | | | |
|---|---|---|---|
| DE | 1130371 | | 10/1960 |
| DE | 18 61 982 | | 11/1962 |
| DE | 42343 | | 11/1963 |
| DE | 2942451 | A1 * | 4/1981 |
| DE | 41 05 412 | A1 | 8/1992 |
| DE | 199 51 663 | A1 | 4/2000 |
| DE | 102006053491 | A1 * | 5/2008 |
| JP | 11267549 | A * | 10/1999 |
| SU | 659193 | * | 4/1979 |
| WO | WO 2004054719 | A1 * | 7/2004 |

* cited by examiner

*Primary Examiner*—Charles E Cooley
(74) *Attorney, Agent, or Firm*—Barnes & Thornburg LLP

(57) ABSTRACT

A separator comprising a centrifugal drum that includes a drum shell having at least one solids discharge nozzle. Further included is at least one wear protection element on the drum shell in an area of and behind the at least one solids discharge nozzle. The at least one wear protection element includes or is constructed as a plate-type body.

27 Claims, 9 Drawing Sheets

CENTRIFUGE HAVING SOLIDS DISCHARGE NOZZLES WITH WEAR PROTECTION

BACKGROUND

The present disclosure relates to a centrifuge, or a separator, comprising a centrifugal basket, or centrifugal drum, having a basket shell or drum shell, which is provided with solids discharge nozzles.

A separator of this type is known from U.S. Pat. No. 3,108,952. In the exterior wall of the centrifugal basket of this separator, solids discharge nozzles are arranged in a mutually angularly offset manner in the area of the largest inside diameter of the centrifugal basket. In this case, nozzle bodies are inserted into bores of the basket shell, which nozzle bodies do not extend radially toward the outside but are oriented in an inclined manner with respect to the respective radial direction in order to utilize the acceleration effect of the product phase exiting from the nozzles, which reduces the power required for rotating the centrifugal basket.

Since the discharge nozzles are arranged in an inclined manner with respect to the radial direction, the product jet exiting from the discharge nozzles can at least, by a certain portion, impact on the exterior wall of the basket or collide with it, which may cause considerable wear of the exterior wall of the basket.

A similar state of the art is illustrated in U.S. Pat. No. 2,695,748. The discharge nozzles illustrated in this document each consist of a first sleeve with a bore extending centrically through the sleeve from the inside radially to the outside. The first sleeves are inserted into the bores of the basket shell. A second sleeve is in each case screwed into them in their end area at an angle with respect to the radial direction, which second sleeve also has a centric bore, so that the product phase exiting from the centrifugal basket is first guided through the first sleeve radially toward the outside and is then guided through the second sleeve from which the product phase exits in an inclined manner with respect to the radial direction against the rotating direction of the separator.

From FIG. 9 of U.S. Pat. No. 2,695,748 of the above-mentioned type, it is also known to insert the first sleeve at an angle with respect to the radial direction in a bore of the basket wall. In this case, at its outer end, the sleeve ends approximately flush with the exterior side of the centrifugal basket, which has the effect that, behind the outlet of the sleeve with the nozzle, the product flow in a recess of the centrifugal basket can impact against the basket shell and can wear out the latter. In practice, the wear results in deep grooves in the basket wall which finally result in expensive maintenance work. For fixing the first sleeve on the centrifugal basket, a projection is used which locks into a groove of the centrifugal basket.

With respect to the state of the art, German Patent Documents DE 11 30 371 B, DE 199 51 663 A, DE 41 05 412 A, DE 18 61 982 U, DD 42343 and U.S. Pat. No. 2,060,239 are also mentioned which, however, are not as close to the invention.

German Patent Document DE 18 61 982 relates to a centrifugal sieve basket with perforations for implementing the sieve function which are filled by hard-metal spouts, the shell of the basket being covered with hard metal.

From German Patent Document DE 41 05 412 A, a solid shell worm-type centrifuge is known in the case of which bores in the basket are lined on the inside with a hard metal for the discharge of solids.

SUMMARY

The present disclosure relates to a way to protect a separator against wear caused by the product phase exiting from the solids nozzles.

The present disclosure relates to a separator, including a drum shell having at least one solids discharge nozzle and at least one wear protection element on the drum shell in an area of and behind the at least one solids discharge nozzle.

According to an embodiment of the present disclosure, separate elements permit an optimal adaptation to a task of wear protection.

According to an embodiment of the present disclosure, the wear protection devices are constructed as coatings, such as a ramp, in the basket or drum shell. This embodiment may be an effective and, under certain circumstances, a lower-cost alternative to the separate wear protection elements.

The wear protection devices may include a wear-resistant material, such as steel or a hard metal or a ceramic material or a combination or a composite of these materials, or they are coated with such a material.

The discharge nozzles may be provided with discharge openings oriented at an angle $\alpha+\beta$ in an inclined manner with respect to a radial direction R. The angle $\alpha+\beta$ between the radial direction R in the area of the discharge nozzles and the orientation of the discharge openings may be equal to or smaller than 90° (for example, between 70 and 85°). Since, in the case of separators with such discharge nozzles, high wear of the basket or drum shell may occur locally, the wear protection elements may be helpful. An orientation angle of the discharge openings with respect to the radial direction R may be between 70 and 90°.

The present disclosure generally relates to separators whose centrifugal basket or drum has a vertical axis of rotation and has a single or double conical construction. The solids discharge nozzles generally are arranged in an area of the largest diameter of the centrifugal basket or drum, and the nozzles are inserted in the drum from the outside.

The present disclosure relates to separators whose discharge openings are arranged offset toward the interior by a distance relative to the largest outer periphery or outside diameter of the centrifugal basket or drum and which each have a recess as an extension of the discharge openings in the basket or drum shell, which receive the wear protection elements.

The wear protection elements may extend from the discharge openings to the outer edge of the basket or drum shell in order to protect the drum shell area of the centrifugal drum which may be stressed.

Other aspects of the present disclosure will become apparent from the following descriptions when considered in conjunction with the accompanying drawings.

DETAILED DESCRIPTION

Figure 1B:
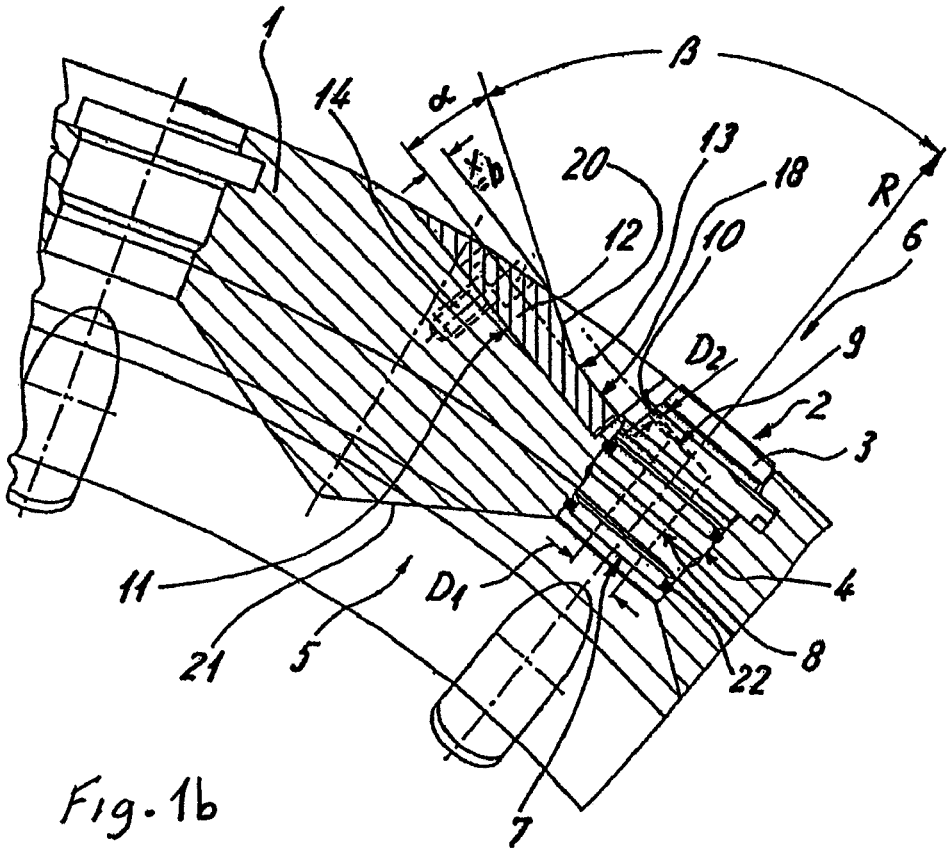
FIG. 1*b* is a top view of an area of the solids discharge nozzle shown in FIG. 1*a*.
Figure 1A:
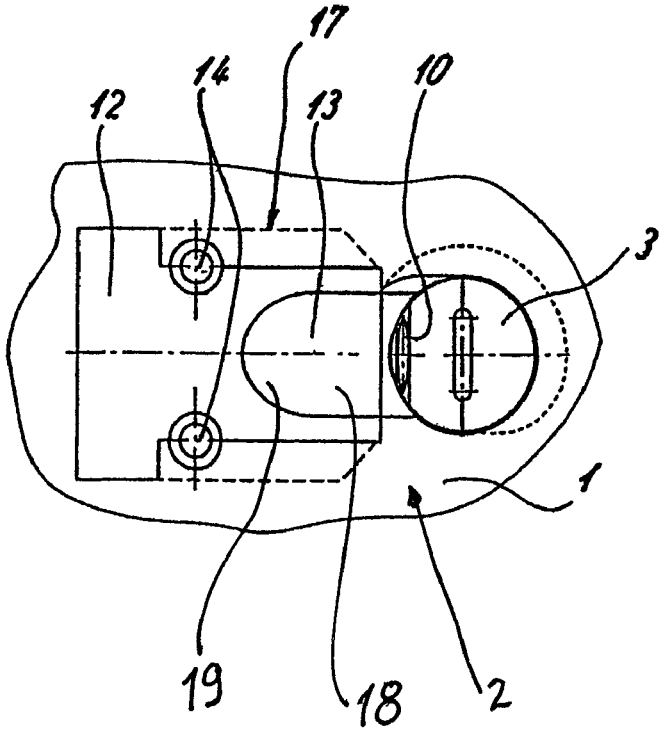
FIG. 1*a* is a side view of a section of an exterior wall of a centrifugal drum shell of an embodiment of a separator in an area of a solids discharge nozzle according to the present disclosure.

FIG. 1*a* illustrates a portion of an outer wall of a basket shell or drum shell 1 of a centrifugal basket or drum 28 (see, for example, FIG. 9) of a separator having an axis of rotation V that is vertically oriented and, which, for example, has a single-cone or double-cone geometry. The drum shell 1 is equipped with at least one, and possibly more discharge nozzles 2 for solids.

The discharge nozzles 2 include a sleeve body 3 and are each inserted, for example, screwed in a radial direction R of the centrifugal drum into bores 4 in the drum shell 1. The bores 4 also extend in the radial direction R. On their outer periphery, the discharge nozzles 2 have sealing rings 22. The drum shell 1 has recesses 21 on an inside in front of the discharge nozzles 2, which recesses 21 taper in a direction of the discharge nozzles 2 and guide solids to the discharge nozzles 2.

The discharge nozzles 2 each include a centric bore 7 which extends from an interior space 5 of the drum shell 1 in a direction of exterior space 6 of the drum shell 1. The center bore 7 extends in a first bore section 8 having a first diameter D1 in the radial direction R from an interior to an exterior of the drum shell 1 or drum 28 (see FIG. 9) and then changes to a bore section 9 which is oriented at an angle with respect to the first bore section 8 and has a smaller diameter D2 relative to the first diameter D1.

A discharge opening 10 of the bore section 9 is oriented at an angle, for example, $\alpha+\beta$, with respect to the radial direction R. The angle $\alpha+\beta$ between the radial direction R and the discharge opening 10 or the second bore area 9 is equal to or smaller than 90° and may be, for example, between 70 and 90°.

Since, on the outside of drum shell 1, the sleeve bodies 3 end essentially flush with an outer edge or wall of the drum shell 1, the discharge opening 10 is offset toward the interior by a distance a relative to the largest outer periphery or outside diameter of the centrifugal drum 28 (see FIG. 9) or of the drum shell 1.

Correspondingly, as an extension of the second bore section 9, a channel-type indentation or recess 11, which is constructed at an angle with respect to the radial direction R, is constructed in the drum shell 1, so that a product phase or solids exiting from the discharge nozzles 2 sprays as completely as possible on the outside past the drum shell 1.

However, it should be noted that a portion of the solids exiting from the discharge nozzles 2 may impact on the drum shell 1 and may cause wear of the drum shell 1, particularly in an exterior area of the recess 11 as well as also farther in a peripheral direction.

To possibly reduce or even possibly avoid the above-noted wear on the drum shell 1, a wear protection element 12 is inserted into the recesses 11. The recesses 11 are constructed separately from the discharge openings 10 and may extend from the discharge openings 10 or from shortly behind the discharge openings 10 to the outer periphery of the drum shell 1 or beyond.

Figure 2B:
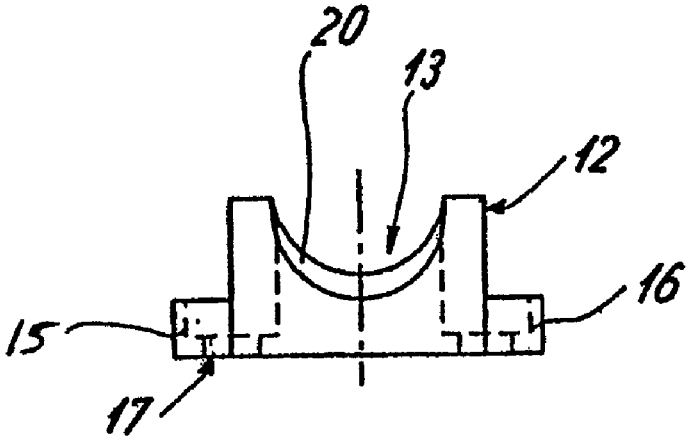
FIG. 2*b* is an elevational view of the wear protection element shown in FIG. 2*a*.
Figure 2A:
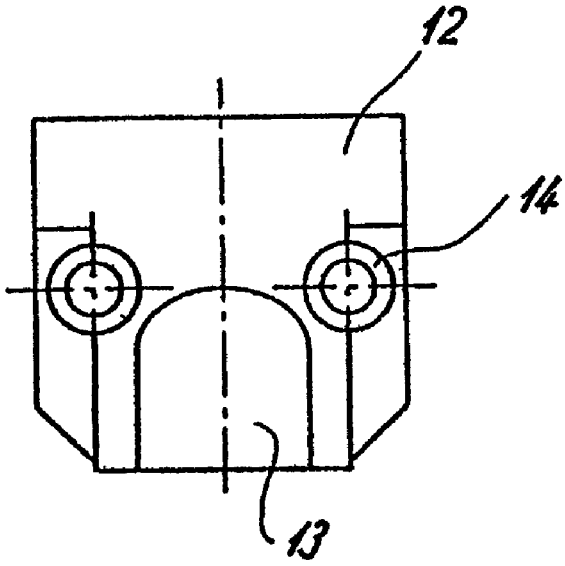
FIG. 2*a* is a side view of the wear protection element shown in FIGS. 1*a* and 1*b*.

The wear protection elements 12 are constructed as plate-type bodies. On a side which is on an exterior in the mounted position, each wear protection element includes a groove or channel 13 which, in a mounted position as shown, for example, in FIGS. 1 and 2, points toward the outside and is used as a guiding or discharge channel for the product phase exiting from the centrifugal drum 1 at angle $\alpha+\beta$ with respect to the radial direction R.

The centrifugal drum is protected against wear by the wear protection elements 12 in the area of the recess 11.

The mounting of the wear protection elements 12 on the drum shell 1 can take place by screws 14 and/or mutually corresponding groove and tongue elements between the drum shell 1 and the wear protection elements 12. Thus, it becomes possible to provide the wear protection elements 12 with a type of base plate 17 molded on in one piece, whose exterior edges can be pushed as tongues 15, 16 into two mutually opposite channels, as suggested by broken lines in FIGS. 1*a* and 1*b*, in a lateral base area of the recess 11.

The wear protection elements 12 can thereby be exchanged in the event of damage or wear. In this manner, the service life of the centrifugal drum may also be increased. The wear protection elements 12 are easily handled and are suitable for retrofitting on existing centrifugal drums.

A base of the semicylindrical channel 13 is offset by a distance b toward a rear with respect to the discharge opening 10 of the discharge nozzle 11. As shown in FIG. 1*b*, distance b corresponds to distance x. Channel 13 can completely or in sections be oriented parallel or at an angle with respect to the second bore section 9 or with respect to the discharge opening 10. The angle may be smaller than 30° and may even be smaller than 20°.

A first area 18 of the channel 13 adjoins the discharge opening 10 parallel to the second bore section 9, whose orientation is at an angle $\alpha+\beta$, as shown in FIG. 1*b*. The angle $\alpha+\beta$ may be smaller than 90°, shown as approximately 80°, and may be between 70 and 85°. The angle $\alpha+\beta$ is inclined with respect to the radial direction R and may also define the discharge angle of the product phase from the centrifugal drum. A second area 19 is oriented slightly farther toward the radial direction R (see angle $\beta$), so that, in an end area of the channel 13, a ramp 20, possibly acting as a break edge or edges, is created which has a maximal height x over a base of the channel 13, which directs a portion of the product flow impacting here slightly farther radially toward the outside and in this manner has a slight braking effect on this portion of the product flow, which may have a positive effect on the operation of the separator.

Figure 3A:
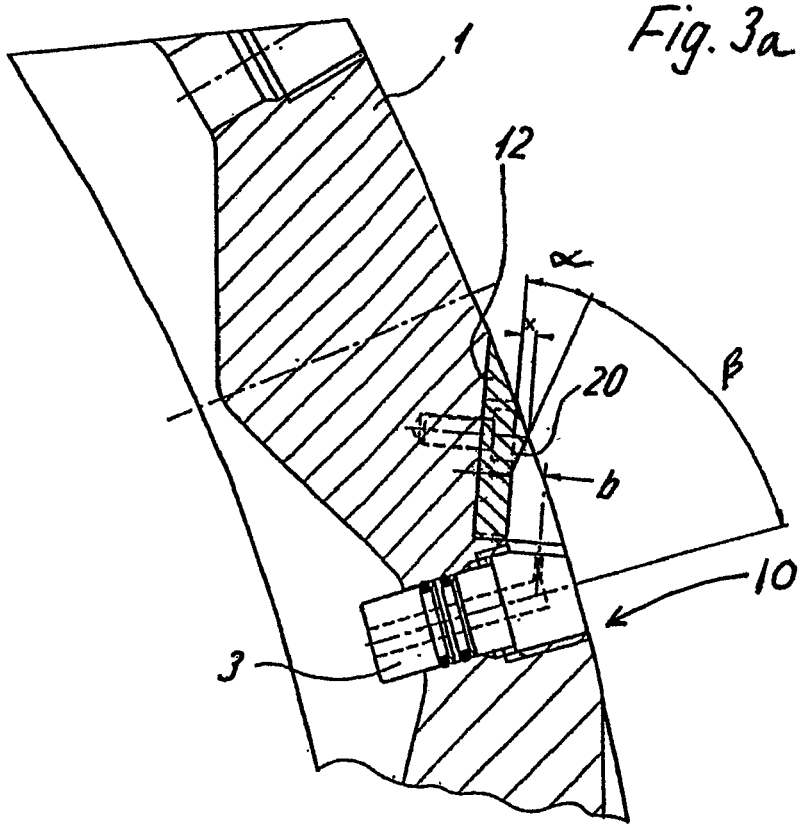
FIG. 3*a* is a side view of an exterior wall of a centrifugal drum shell of another embodiment of a separator in an area of a solids discharge nozzle, according to the present disclosure.
Figure 3B:
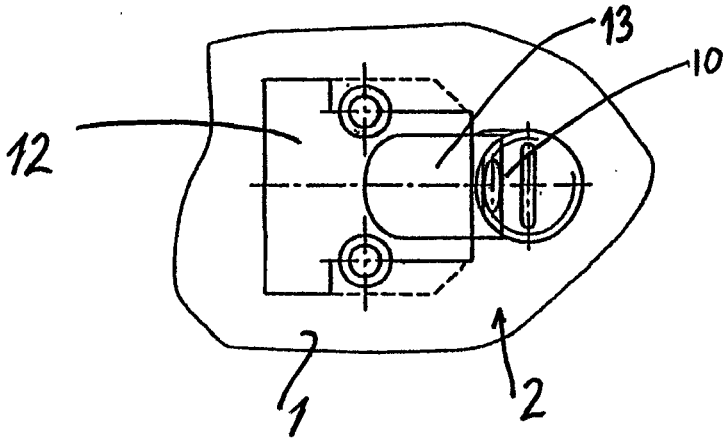
FIG. 3*b* is a top view of an area of the solids discharge opening shown in FIG. 3*a*.
Figure 4A:
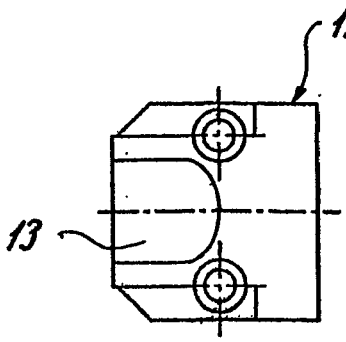
FIG. 4*a* is a side view of the wear protection element shown in FIGS. 3*a* and 3*b*.
Figure 4B:
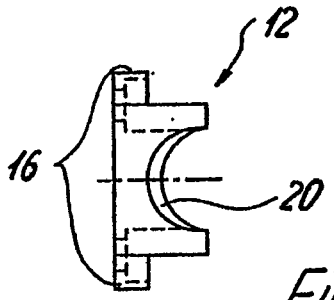
FIG. 4*b* is an elevational view of the wear protection element shown in FIG. 4*a*.

The wear protection elements 12 are suitable for use with sleeve bodies 3 as shown in FIG. 1*b* and which sleeve bodies 3, in an interior, close off flush with an interior side of the drum shell 1. The wear protection elements 12 are compatible as well for sleeve bodies 3 as shown in FIG. 3*b*. The sleeve bodies 3, project slightly into the interior of the centrifugal drum shell 1 so that deposits can form around the sleeve bodies 3 which, in a processing of certain products, may have a positive effect on such product processing.

As suggested in FIGS. 1*a*, 1*b*, 3*a* and 3*b*, the wear protection elements 12 extend from the discharge openings 10 to an outer edge of the recesses 11, so that an entire area of the recesses 11 is protected against wear.

As shown in FIGS. 1*b* and 3*b*, the ramps 20, acting as break edges, extend in a longitudinal direction of the channel 13 over less than half its length, for example, over a distance of up to 20 mm and conceivably over a distance of from 1 to 5 mm. The height x, shown in FIG. 1*b* as x=b, of these break edges or of the ramps may be 1-10 mm. With respect to a precise height, it may be determined at least partly by a diameter of the drum.

The base of the channel 13 may be situated closely below the discharge opening 10. A distance between the discharge opening 10 and the base of the channel 13, as well as their diameters, may influence the type and manner of the product flow discharge. In FIG. 3*b*, height x is less than distance b, so that the solids may partially flow directly over an edge of the ramp 20. In addition, the length of the wear protection elements 12 in a peripheral direction is shorter than the wear protection elements 12 shown in FIG. 1*b*.

The geometry of a transition between the ramp 20 and a remainder of channel 13 may be curved or abrupt. It may also follow the geometry of a trigonometric or exponential function. An inclination of the ramp 20 with respect to a discharge direction of solids increases as the ramp 20 moves away from the discharge opening 10.

As an extension of the channel 13, the geometry of the wear protection elements 12 is adapted to a curvature of the drum shell 1 in order to ensure protection.

According to the embodiment of FIGS. 5*a-d*, the ramps 20 project radially toward the outside beyond an outer periphery or largest diameter of the centrifugal drum shell 1. Ramp 20 guides product flow still farther toward the outside and contributes to preventing that the latter can come in contact with the drum shell 1. To that end, an undercut 23 or undercut break edge is formed.

Figure 5B:
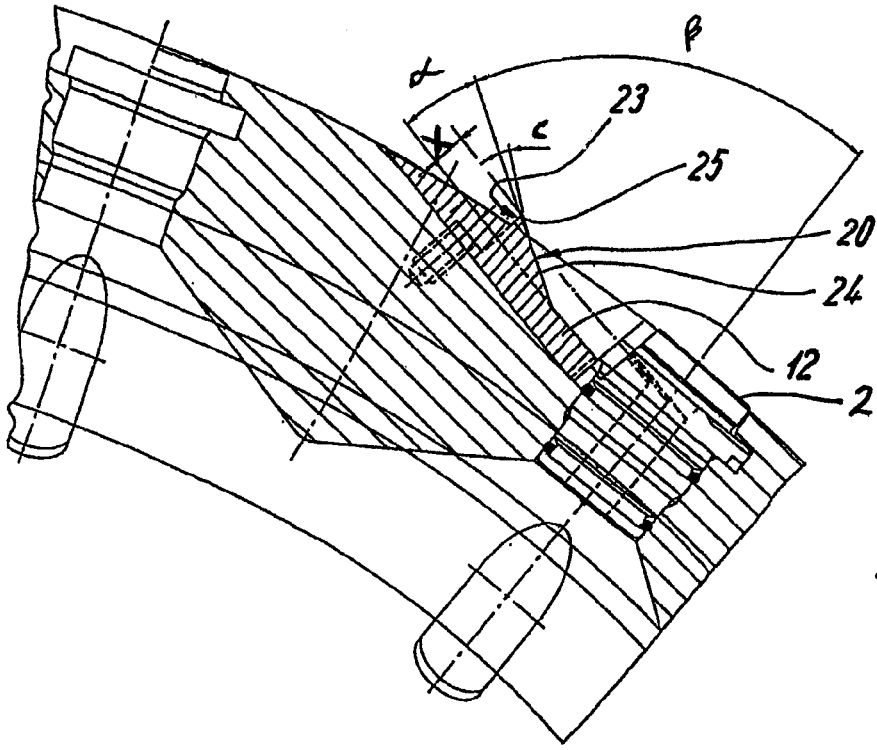
FIG. 5*b* is a top view of an area of the solids discharge nozzle shown in FIG. 5*a*.
Figure 5A:
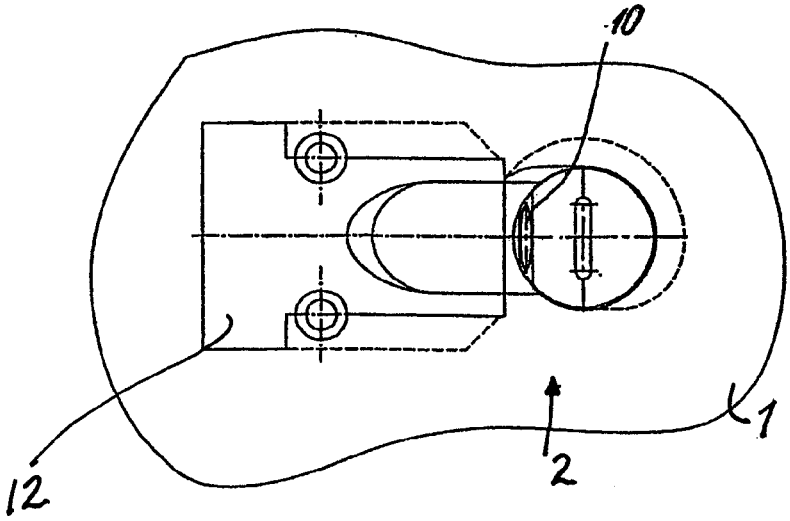
FIG. 5*a* is a side view of an exterior wall of a centrifugal drum shell of another embodiment of a separator in an area of a solids discharge nozzle, according to the present disclosure.
Figure 5C:
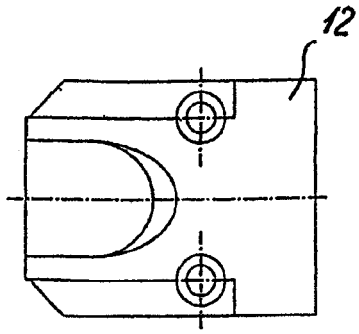
FIG. 5*c* is a side view of the wear protection element shown in FIGS. 5*a* and 5*b*.
Figure 5D:
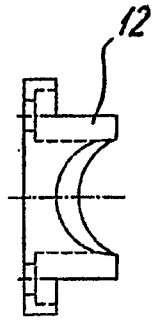
FIG. 5*d* is an elevational view of the wear protection element shown in FIG. 5*c*.
Figure 6B:
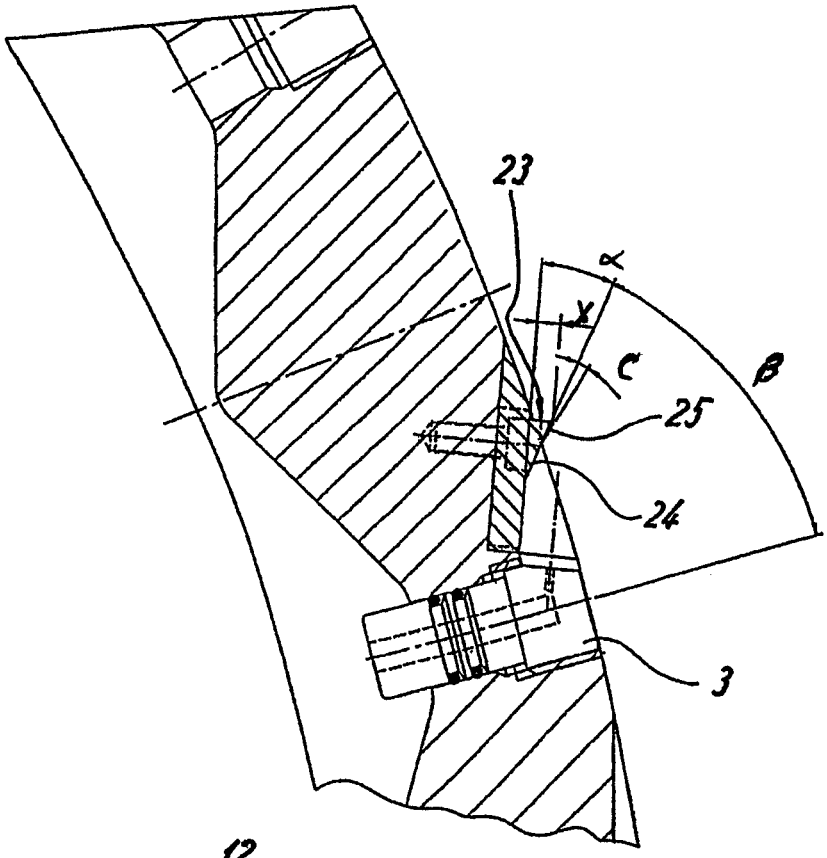
FIG. 6*b* is a top view of an area of the solids discharge nozzle shown in FIG. 6*a*.
Figure 6A:
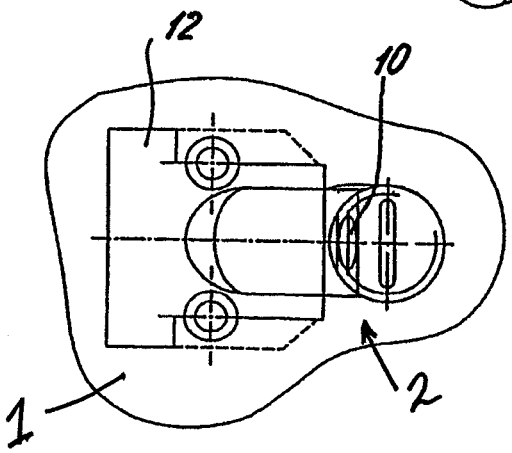
FIG. 6*a* is a side view of an exterior wall of a centrifugal drum shell of another embodiment of a separator in an area of a solids discharge nozzle, according to the present disclosure.
Figure 6C:
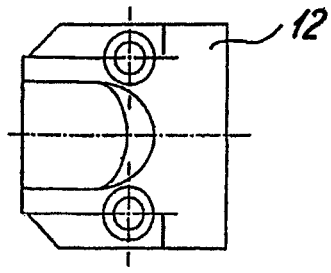
FIG. 6*c* is a side view of the wear protection element shown in FIGS. 6*a* and 6*b*.
Figure 6D:
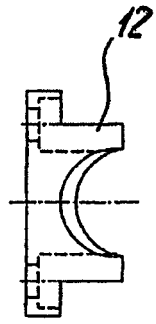
FIG. 6*d* is an elevational view of the wear protection element shown in FIG. 6*c*.

Ramp 20, as shown in FIG. 5*b*, is constructed in the manner of a "ski jump". Ramp 20 has an angle $\alpha>0$ with respect to the discharge direction of the product flow from the discharge nozzle 2 in a first area 24. In an adjoining area 25, ramp 20 has a larger angle $\alpha+c$ ($\alpha>0$; $c>0$) with respect to the discharge direction of the product flow from the discharge nozzle 2.

An analogous situation applies to FIGS. 6*a*-6*d*. However, here the ramps 20 project still farther beyond the outer periphery of the drum shell 1 toward the outside.

Figure 9:
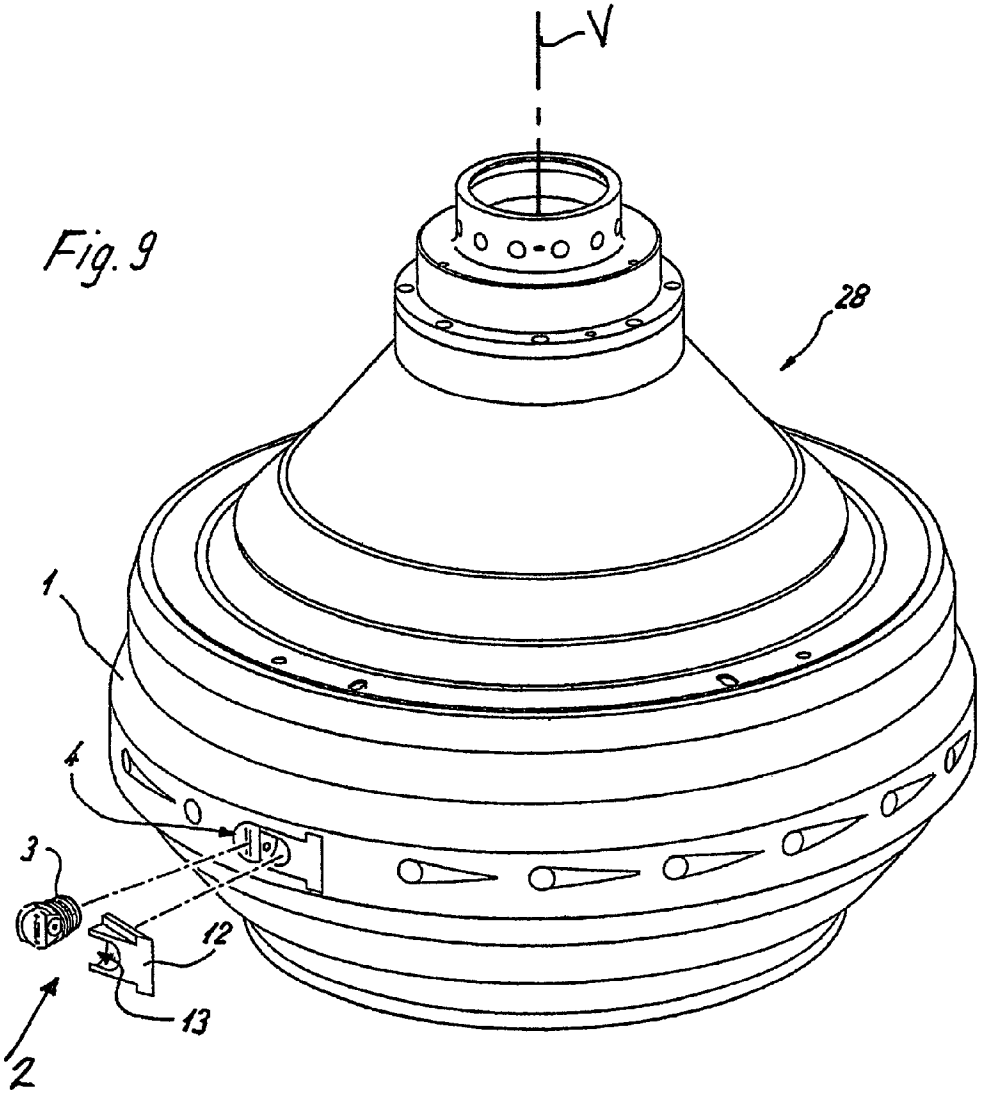
FIG. 9 is a perspective view of a separator drum, according to the present disclosure.
Figure 10:
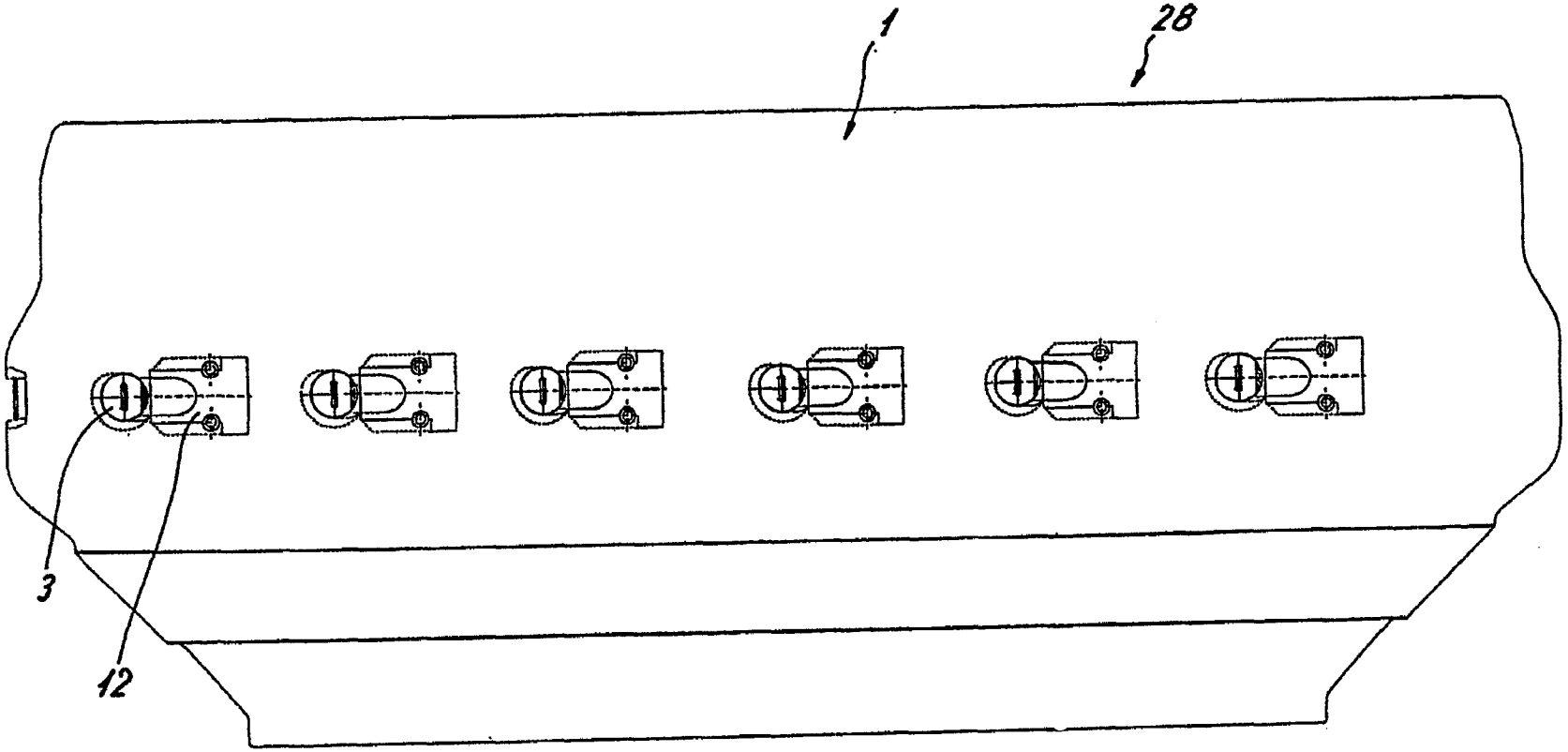
FIG. 10 is a lateral view of a section of the separator drum of FIG. 9.

FIG. 9 is a perspective view of a centrifuge or separator drum 28 according to, for example, the embodiment shown in FIGS. 1*a* and 1*b*. A double-cone geometry of the centrifugal drum 28 or of the drum shell 1 with bores 4 in an area of the largest diameter or in an area of a transition from a lower conical section to an upper conical section of the drum shell 1 is visible. The discharge nozzles 2 or the sleeve bodies 3 having an external thread, so that they can be screwed from the outside into the bores 4 with a corresponding internal thread. The separately constructed wear protection elements 12 with their groove or channel 13 are also recognizable. One wear protection element 12 may be provided behind each discharge nozzle 2 in a rotating direction. FIG. 10 shows a lateral view of the centrifugal drum 28 and the drum shell 1.

The embodiments shown in FIGS. 7*a*, 6, 8*a* and 8*b* show no wear protection element 12 constructed on the drum shell 1. Instead, a type of ramp 26 is constructed at the base of the recess 11 in the drum shell 1 so that the product flow is directed farther radially toward the outside. This may also reduce a wear problem because at least the entire drum shell 1 is not detrimentally affected. The ramp 26 may be coated with a wear protection alloy for example, a hard metal or a titanium alloy.

Figure 7B:
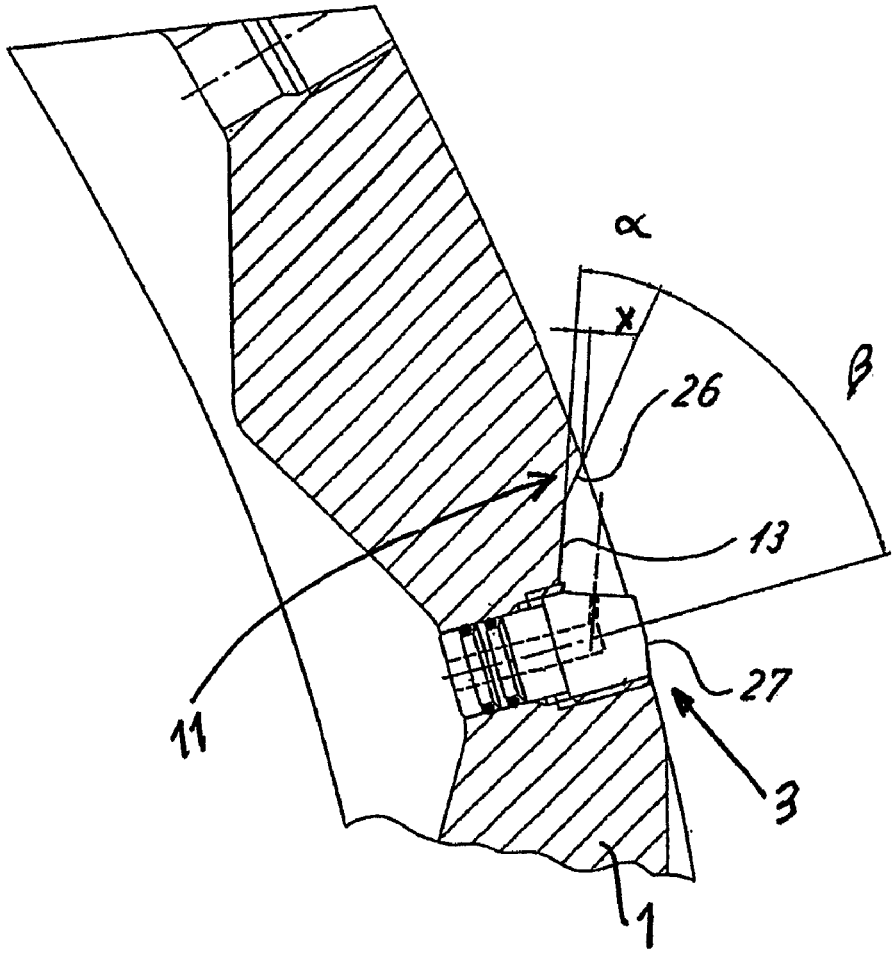
FIG. 7*b* is top view of an area of the solids discharge nozzle shown in FIG. 7*a*.
Figure 7A:
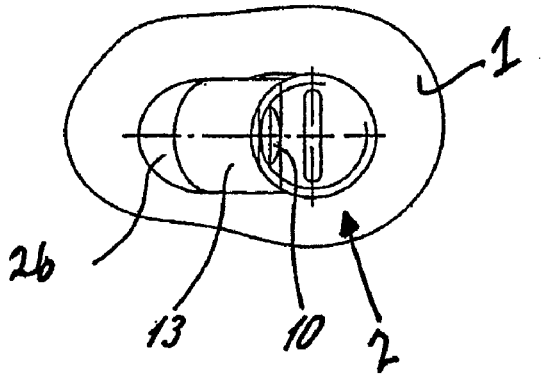
FIG. 7*a* is a side view of an exterior wall of a centrifugal drum shell of another embodiment of a separator in an area of a solids discharge nozzle, according to the present disclosure.
Figure 8B:
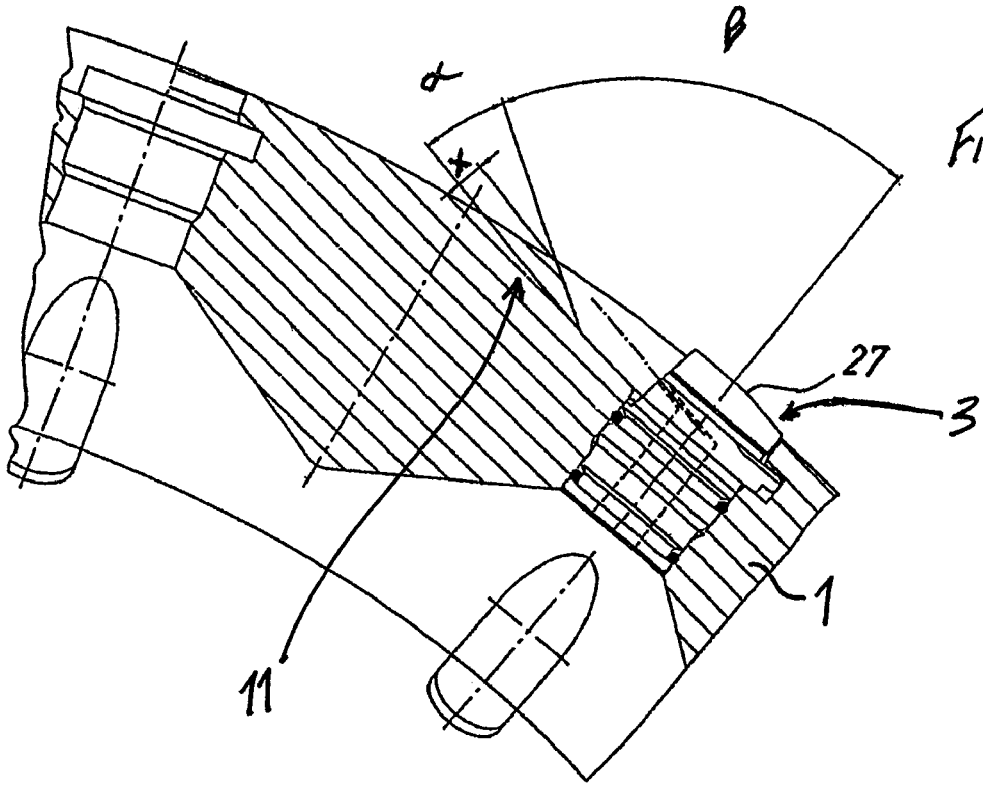
FIG. 8*b* is a top view of an area of the solids discharge nozzle shown in FIG. 8*a*.
Figure 8A:
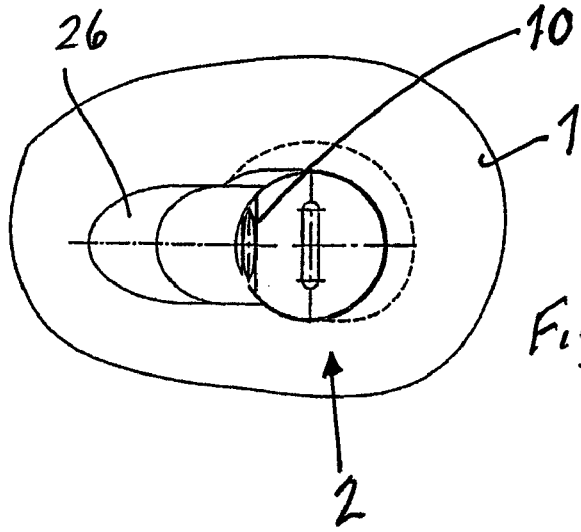
FIG. 8*a* is a side view of an exterior wall of a centrifugal drum shell of another embodiment of a separator in an area of a solids discharge nozzle, according to the present disclosure.

In FIGS. 7*b* and 8*b*, nozzle or sleeve body 3 projects in a ramp-type manner beyond an outer periphery of the drum shell 1 toward the outside and forms a type of ramp 27, so that, during an operation, ramp 27 provides a certain deflection of the product flow discharged from the nozzle or sleeve body 3.

While the two embodiments of FIGS. 7*a*, 7*b*, 8*a* and 8*b* do not include the same type of wear protection, for example, wear protection elements 12, these two embodiments do have favorable wear protection as described in the paragraphs above.

Although the present disclosure has been described and illustrated in detail, it is to be clearly understood that this is done by way of illustration and example only and is not to be taken by way of limitation. The scope of the present disclosure is to be limited only by the terms of the appended claims.

We claim:

1. A separator comprising:

a centrifugal drum including a drum shell having at least one solids discharge nozzle; and at least one wear protection element on the drum shell in an area of and behind the at least one solids discharge nozzle; and wherein the at least one wear protection element is constructed as a plate-type body having a channel configured as a discharge channel for a product phase exiting from the centrifugal drum at an angle inclined with respect to a radial direction, the angle being between the radial direction in the area of the at least one discharge nozzle and an orientation of a discharge opening of the at least one discharge nozzle.

2. The separator according to claim 1, wherein the at least one wear protection element is fastened to the drum shell by at least one of the following: a) screws and b) mutually corresponding groove and tongue elements between the drum shell and the at least one wear protection element.

3. The separator according to claim 1, wherein a base of the channel is situated at a distance offset from an outer periphery of the drum shell toward an interior of the centrifugal drum with respect to a discharge opening of the at least one discharge nozzle in the drum shell, and in that the channel is oriented one of a) completely and b) in sections, the sections being one of a) parallel and b) at an angle with respect to a discharge opening of the at least one discharge nozzle.

4. The separator of claim 3, wherein the angle with respect to the discharge opening is less that 30°.

5. The separator according to claim 3, wherein the angle with respect to the discharge opening is less than 20°.

6. The separator according to claim 1, wherein the channel transitions into a ramp.

7. The separator according to claim 6, wherein the ramp, acting as a break edge, extends in a longitudinal direction of the channel over a distance of less than half a length of the channel, such distance being 1 to 10 mm.

8. The separator according to claim 6, wherein a geometry of the transition between the ramp and the channel is at least one of the following: a) curved and b) abrupt.

9. The separator according to claim 6, wherein a geometry of the transition between the ramp and the channel is at least one of the following: a) a circle and b) an exponential function.

10. The separator according to claim 6, wherein an inclination of the ramp with respect to the discharge opening increases in a direction away from the discharge opening.

11. The separator according to claim 6, wherein the ramp of the at least one wear protection elements projects radially beyond an outer periphery of the drum shell.

12. The separator according to claim 6, wherein the ramp is constructed as an undercut break edge.

13. The separator according to claim 1, wherein a first area of the channel adjoins a discharge opening of the at least one discharge nozzle, the first area being parallel to a bore section, and a second area of the channel) is inclined farther toward the radial direction.

14. The separator according to claim 1, wherein a geometry of the at least one wear protection element, as an extension of the channel, is adapted to a curvature of the drum shell.

15. A separator comprising:

a centrifugal drum including a drain shell having at least one solids discharge nozzle; and at least one wear protection element on the drum shell in an area of and behind the at least one solids discharge nozzle;

wherein the at least one discharge nozzle includes a discharge opening oriented at an angle inclined with respect to a radial direction, and in that the angle, between the radial direction in the area of the at least one discharge nozzle and an orientation of the discharge opening, is equal to or smaller than 90°;

wherein a recess is constructed as an extension of the discharge opening in the drum shell and the recess is configured to receive the at least one wear protection element; and wherein the at least one wear protection element includes a base plate having tongues as outer edges, the tongues configured to be pushed into two mutually opposite grooves in a lateral base area of the recess.

16. The separator according to claim 15, wherein the angle is between 70 and 85°.

17. The separator according to claim 15, wherein the discharge opening is arranged at an offset distance from an outer periphery of the drum shell toward an interior of the centrifugal drum.

18. The separator according to claim 17, wherein the at least one wear protection element extends from the discharge opening to the outer periphery of the drum shell.

19. The separator according to claim 15, wherein the at least one wear protection element is constructed as a ramp at the at least one discharge nozzle which projects radially beyond the drum shell.

20. A separator comprising:

a centrifugal drum including a drum shell having at least one solids discharge nozzle; and at least one wear protection element on the drum shell in an area of and behind the at least one solids discharge nozzle; and further including a sleeve body as part of the at least one discharge nozzle, the sleeve body configured to close off flush with an interior side of the drum shell.

21. The separator according to claim 20, wherein the centrifugal drum has a vertical axis of rotation and at least one of the following: a) a single-cone and b) a double-cone construction.

22. The separator according to claim 20, wherein the at least one solids discharge nozzle is located in an area of the largest diameter of the centrifugal drum and is inserted into the centrifugal drum from an outside of the centrifugal drum.

23. The separator according to claim 20, wherein the at least one wear protection device is constructed as a ramp in the drum shell.

24. The separator according to claim 20, wherein the at least one wear protection element is made of a wear-resistant material that includes one or more of the following: a) steel, b) a hard metal, c) a ceramic material and d) a combination of one or more of a), b), c) and d).

25. The separator according to claim 20, wherein the sleeve body projects slightly into an interior of the centrifugal drum.

26. The separator according to claim 20, wherein the sleeve body is inserted in the radial direction of the centrifugal drum into a radially extending bore of the drum shell.

27. The separator according to claim 20, wherein the sleeve body includes a bore extending from an interior drum space to an exterior drum space and, which sleeve body extends in a first bore section having a first diameter in the radial direction from the interior space to the exterior space and the first bore section changes into a second bore section oriented at an angle with respect to the first bore section and has a smaller second diameter relative to the first diameter.

* * * * *